United States Patent [19]

Carroll et al.

[11] Patent Number: 4,573,539

[45] Date of Patent: Mar. 4, 1986

[54] HYDRAULICALLY PULSED INDEXING SYSTEM FOR SLEEVE-TYPE CORE BARRELS

[75] Inventors: Jimmy L. Carroll, Bountiful; James T. Aumann, Salt Lake City, both of Utah

[73] Assignee: Norton Christensen, Inc., Salt Lake City, Utah

[21] Appl. No.: 539,924

[22] Filed: Oct. 7, 1983

[51] Int. Cl.[4] ..... E21B 25/06

[52] U.S. Cl. ..... 175/58; 175/245; 175/251; 175/247

[58] Field of Search ..... 175/58, 20, 44, 49, 175/236, 239, 244, 245, 247, 248, 249, 250, 251

[56] References Cited

U.S. PATENT DOCUMENTS

| | | | |
|---|---|---|---|
| 2,019,176 | 10/1935 | Dodds | 175/234 |
| 2,927,775 | 3/1960 | Hildebrandt | 175/245 |
| 2,927,776 | 3/1960 | Hildebrandt | 175/245 |
| 3,012,622 | 12/1961 | Austin | 175/237 |
| 3,804,184 | 4/1974 | Gusman et al. | 175/226 |
| 3,833,074 | 9/1974 | Courtois | 175/87 |
| 4,512,419 | 4/1985 | Rowley et al. | 175/58 |
| 4,512,423 | 4/1985 | Aumann et al. | 175/249 X |

*Primary Examiner*—Stephen J. Novosad
*Assistant Examiner*—M. Goodwin
*Attorney, Agent, or Firm*—Beehler, Pavitt, Siegemund, Jagger & Martella

[57] ABSTRACT

A coring tool, which includes a flexible wire mesh in which the core is disposed, includes a mechanism for maintaining tension on the wire mesh sleeve which then seizes the core disposed within the sleeve, and which serves to retain the core and maintain it under tension. The sleeve is maintained under tension by tensile force transmitted to the sleeve through a stripper tube. The stripper tube is axially disposed through a piston ratchet assembly connected to a piston slidable within the drill string. The piston is resiliently urged upward within the drill string by a return spring but is longitudinally forced downward within the drill string and advanced downwardly with respect to the stripper tube by an increase in pressure within the drill string thereby compressing the return spring. The piston ratchet assembly prevents the piston from moving longitudinally upward with respect to the stripper tube and thereby allows the resilient force of the preloaded spring to be applied through the piston and piston ratchet assembly to the stripping tube as a tensile force on the wire mesh sleeve. A fixed ratchet assembly is provided within the coring tool to prevent any downward movement of the stripper tube through the fixed ratchet assembly thereby maintaining tension on the stripper tube while the piston is being advanced in response to an increase in fluidic pressure.

16 Claims, 7 Drawing Figures

HYDRAULICALLY PULSED INDEXING SYSTEM FOR SLEEVE-TYPE CORE BARRELS

BACKGROUND OF THE INVENTION

1. Field of the Invention

The present invention relates to the field of earth boring tools and more particularly to apparatus and methods for obtaining cores from formations within bore holes.

2. Description of the Prior Art

For many years the oil industry has suffered with poor coring performance resulting in high costs of obtaining a core from hard, fractured formations. The primary problem associated with these formations is frequent jamming inside the inner tube, in the bit throat and in the core catcher area. Jamming increases the number of trips required, increases damage to the core and can result in poor recovery due to the inability of the catcher to reliably grip and hold the broken core. Core from layered, fractured formations can be of interest to the geologists and reservoir analysts, but core recovered from these particular sections, utilizing conventional coring equipment, is frequently so badly damaged that many core analysis techniques cannot be accurately employed. Thus, the core, the acquisition for which a premium was paid, is of little value.

In response to these shortcomings, a novel core barrel has been developed by the assignee of the present invention wherein a rubber sleeve is provided for jacketing the core, see for example Austin "Core Barrel Apparatus" U.S. Pat. No. 3,012,622. Unfortunately, the rubber sleeve core barrel is unsatisfactory for coring hard, fractured formations as the sharp edges of the formations easily cut the rubber sleeve. In addition, a rubber sleeve cannot be used at high temperatures such as are encountered in deep or geothermal wells where hard, fractured rock is often encountered.

In response thereto, the assignee of the present invention developed a new core barrel wherein a specially designed wire mesh sleeve is employed. A woven or braided wire mesh sleeve constricts about the core when under tension, thereby grasping and lifting the core within the inner barrel. The wire mesh sleeve is pulled around the lower end of the inner tube into the core barrel at the same rate as the core is cut and acts as a cylindrical conveyor. It grips and supports the weight of the core, lifting it up the inner barrel, and serves as a continuous core catcher. When under tension, the wire mesh sleeve decreases in diameter and grips the core, keeping the core in its original diameter and thereby prevents jams. The same compacting force of the wire mesh sleeve when under tension also retains unconsolidated small pieces of rock in their original orientations, prevents relative movement of unconsolidated materials within the core and prevents additional core damage.

The improved core barrel sleeve as described in greater detail in co-pending applications entitled "A CORING DEVICE WITH AN IMPROVED CORE SLEEVE AND ANTI-GRIP COLLAR," Ser. No. 530,784, filed Sept. 9, 1983; "A CORING DEVICE WITH AN IMPROVED WEIGHTED CORE SLEEVE AND ANTI-GRIPPING COLLAR," Ser. No. 530,783, filed Sept. 9, 1983; and "A CORING DEVICE WITH AN IMPROVED CORE SLEEVE AND ANTI-GRIPPING COLLAR WITH A COLLECTIVE CORE CATCHER," Ser. No. 537,115, filed Sept. 29, 1983.

Although the wire mesh core barrel just described provides outstanding service in many applications, it remains subject to some operational disadvantages. Firstly, the weight on the drilling bit, that is the force which causes the bit to drill into the rock formation, is produced within such a prior system only by a limited pressure drop in the tool. The pressure drop acts across the sealed area of a slip joint which is used to tension the wire mesh core. In addition, the use of a slip joint can make core jams difficult to detect in some circumstances. In soft formations the rotary table mud pumps must first be stopped before the slip joint can be closed, thereby allowing an additional segment of the core to be cut while the core sleeve is maintained under tension. Stopping the rotary table mud pumps is not only a disruption to the drilling operation but can in some instances cause additional damage to the core or initiate a core jam. Finally, a core sleeve using a slip joint is particularly susceptible to being prematurely activated in an offshore floating drilling platform because of normal wave action. In such cases, the wave action may jack the stripper tube up prematurely.

Therefore, what is needed is an apparatus and methodology for lifting a stripper tube and sleeve within a core barrel as the bit penetrates the formation in a manner which is not subject to the above denoted difficulties.

BRIEF SUMMARY OF THE INVENTION

The invention is an apparatus for use in a coring tool in a drill string which includes a core barrel and a flexible sleeve for receiving the core into the core barrel. The apparatus comprises a stripper tube coupled to the flexible sleeve, which tube is concentrically disposed within the core barrel. A piston is slidingly disposed within the coring tool. The stripper tube is disposed through the piston and is generally longitudinally displaceable with respect thereto. The piston selectively applies a tensile force to the stripper tube and thence to the flexible sleeve and core which is disposed within the sleeve. By this combination a core is cut from a highly fractured rock formation and is retentively disposed within the flexible sleeve. At all times, the sleeve is continuously maintained under tension by the combined operation of the piston and stripper tube.

The apparatus further comprises a fixed ratchet assembly disposed within the coring tool and fixed thereto. The stripper tube is disposed through the fixed ratchet assembly and is longitudinally displaceable with respect thereto. The fixed ratchet assembly maintains the tensile force on the stripper tube, on the flexible sleeve and on the core when the piston is being selectively actuated. In the preferred embodiment, the piston is actuated by an increase in hydraulic pressure transmitted through the coring tool. In one embodiment the piston includes at least one nozzle for creating a pressure differential across the piston in response to the increased flow in the coring tool thereby creating an actuating force on the piston. In another embodiment the piston allows substantially free longitudinal flow of hydraulic fluid through it. In that embodiment, the piston defines a circumferential chamber between the piston and the coring tool in which the piston is slidingly disposed. The circumferential chamber is hydraulically communicated with the ambient environment exterior to the coring tool so that, when the increase in hydraulic pressure within the coring tool causes a differential pressure to be exerted across the piston, the piston is selectively actuated. In addition, in both embodiments the piston is resiliently biased by a preloaded return spring which configures the piston in a first noncompressed configuration.

The operation of the above device is effected by a method which retrieves the core from the bore hole. The method comprises the steps of disposing the core cut by the coring bit into a sleeve. The sleeve is arranged and configured to restrict in diameter and to seize the core when under tension. The sleeve is then tensioned by applying an upward tensile force by a stripper tube which is coupled to the sleeve. The tensile force is applied to the stripper tube by a longitudinally slidable piston disposed within the coring tool. The piston is resiliently longitudinally upwardly urged to create the tensile force coupled by the piston to the stripper tube and thence to the sleeve and core. An additional incremental length of core is continuously cut. The incremental length is substantially equal to the maximum longitudinal displacement of the piston within the coring tool. However, while the piston is being longitudinally displaced within the coring tool through its maximum piston displacement, tension is simultaneously and continuously maintained on the sleeve. The process of disposing the core into the sleeve, tensioning the sleeve, continuously cutting the core and displacing the piston while maintaining the tension on the sleeve and core is cyclically repeated while additional increments of the core are continuously cut without an interruption in cutting operation until a predetermined length of core has been cut.

The apparatus and method of the invention can better be understood by now considering the preferred embodiments as illustrated in the following drawings.

The above embodiments and their operation are better understood by considering the detailed description below.

DETAILED DESCRIPTION OF THE PREFERRED EMBODIMENTS

Figure 2:
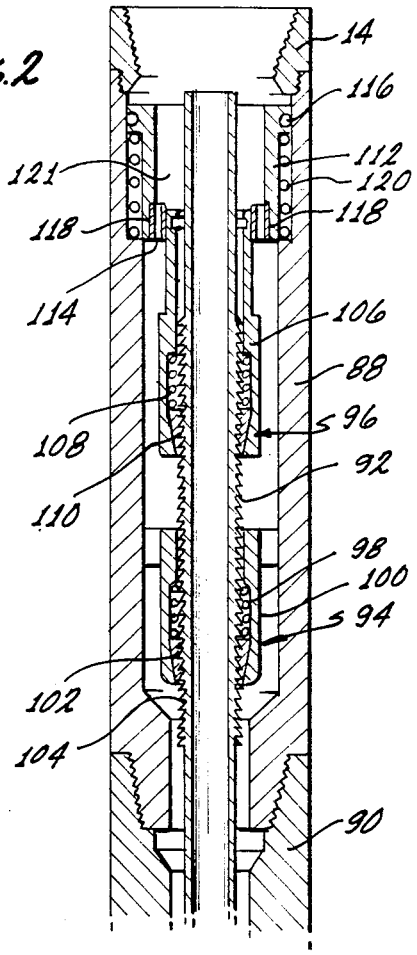
FIG. 2 is a sectional view of a portion of a core tool incorporating a second embodiment of the invention.
Figure 3:
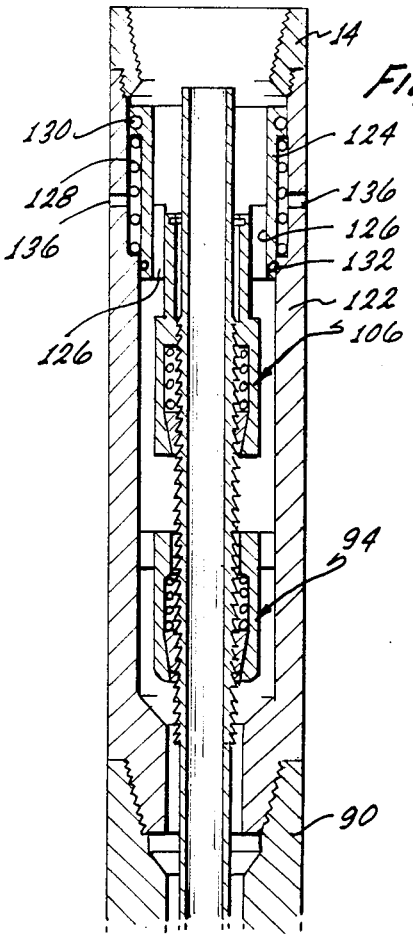
FIG. 3 is a sectional view of a core tool incorporating a third embodiment of the inventon.

The present invention is a mud pulse system utilizing a novel apparatus and method to lift the stripper tube and sleeve as the core barrel bit penetrates the formation. Mud pressure pulses, increases or decreases are created by a valve system described below in greater detail in connection with FIG. 5. The valve is operated automatically or manually in a manner as discussed in connection with FIG. 4. The depth drilled is measured with the device monitoring the motions of the hook or drill string, and a pulse is produced with each increment drilled. The hydraulic pulses used down hole as described in greater detail in connection with FIGS. 1–3 are used to lift the stripper tube in the core barrel.

As is described in detail in connection with FIGS. 1*a*–1*c*, 2 and 3, opening and closing the valve described in connection with FIG. 5 causes a pressure or mud velocity pulse to be transmitted down the drill string. The pressure pulse acts over the area of a piston included in the core barrel. As a result, the piston is compressed against a return spring when the hydraulic force applied to the piston is greater than the preload of the return spring. The piston is racheted so that it moves and remains in a compressed configuration and thereby applies a tensile force on the stripper tube, again as described in detail in connection with FIGS. 1*a*–1*c*, 2 and 3. After the pressure is reduced in the drill string by activation of the valve in FIG. 5, the full force of the return spring is thus exerted through the racheted piston on the stripper tube. As additional core is cut, the piston then relaxes to its relatively noncompressed position vis-a-vis the core barrel. An increase in pressure is then applied once again to repeat the process. The operation of the invention, its structure and its various embodiments can now be best understood by considering the first embodiment illustrated in FIGS. 1*a*–1*c*.

Figure 1A:
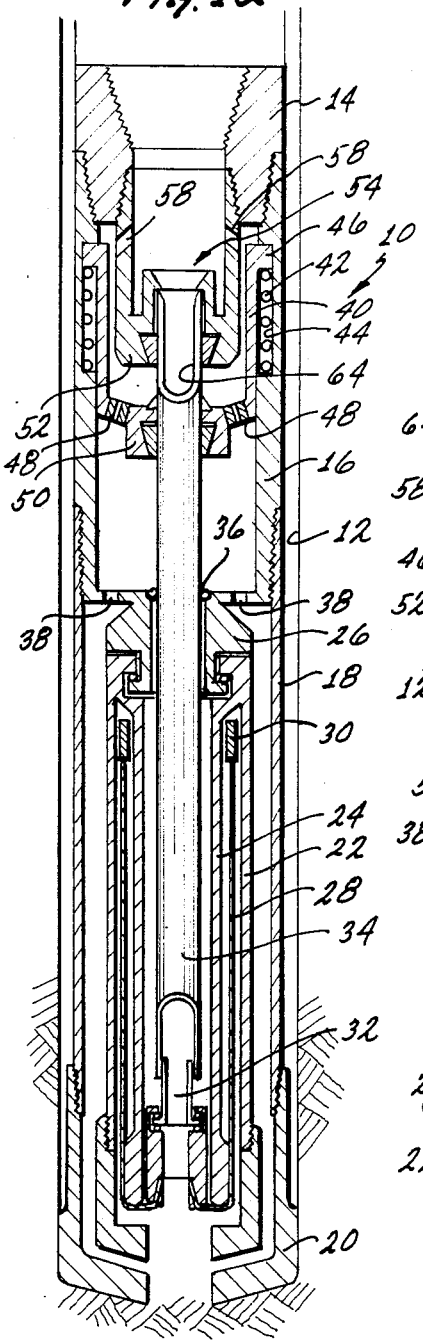
FIG. 1*a* is a diagrammatic sectional view of the lower portion of a core barrel incorporating the invention illustrating the core barrel as it is being lowered within the well bore.

Turn now to FIG. 1*a* wherein a sectional view of the coring tool, generally denoted by reference numeral 10 is depicted as it is being lowered in a bore hole 12. In the view of FIG. 1*a*, tool 10 has just made contact with the bottom of bore hole 12. Coring tool 10 includes a conventional drill collar 14 threadably connected to a stripper sub 16. Stripper sub 16 is conventionally connected at its opposing end to an outer barrel 18 which in turn is connected to a rotary coring bit 20. Concentrically disposed within outer barrel 18 is an intermediate tube 22 and inner tube 24. Intermediate tube 22 and inner tube 24 are each rotatably coupled to a bearing assembly 26. Bearing assembly 26 in turn is integrally formed as part of stripper sub 16 and thereby rotates with outer barrel 18 while allowing intermediate tube 22 and inner tube 24 to remain rotationally stationary with respect to outer barrel 18 and bore hole 12. Concentrically disposed between intermediate tube 22 and inner tube 24 is a wire mesh or flexible rubber sleeve 28 compressed at its upper end by annular weight 30. Flexible sleeve 28 is substantially as described in copending applications referenced above.

The lower end of sleeve 28 is connected to stripper tube swivel 32. Stripper tube swivel 32 in turn is rotatably coupled through a conventional ball bearing to the lower end of stripper tube 34. Stripper tube 34 is concentrically disposed within outer barrel 18, intermediate tube 22, sleeve 28 and inner tube 24. Stripper tube 34 is also axially disposed along the longitudinal axis of coring tube 10 and extends upwardly through bearing assembly 26 into and along the longitudinal axis of stripper sub 16. An O-ring seal 36 between stripper tube 34 and bearing assembly 26 provides hydraulic sealing therebetween in order to prevent hydraulic fluid from penetrating into the upper end of inner tube 24 and thereby disturbing the core.

Bearing assembly 26 includes a plurality of ports 38 longitudinally defined therethrough in order to provide communication of hydraulic fluid from the interior of stripper sub 16 into the interior outer barrel 18 and thence to bit 20 for use as a conventional cooling and cleaning agent.

Stripper tube 34 is axially disposed through slidable piston 40 and is fluidically sealed thereto by conventional means. Piston 40 is concentrically disposed within stripper sub 16 and is resiliently biased in an upward position as shown in FIG. 1*a* by means of a compression coil return spring 42. Spring 42 is preloaded in the open position of FIG. 1*a* with a predetermined force. Spring 42 is disposed within an annular indentation 44 defined in the interior walls of stripper 16 in which indentation 44 an integrally formed collar 46 of piston 40 also travels. The upper end of spring 42 is thus seated against collar 46 of piston 40 while the opposing end of spring 42 seats against the lower shoulder defining indentation 44. Collar 46 of piston 40 is hydraulically sealed with respect to stripper 16 while no seal is provided between piston 40 and indentation 44 at its opposing end.

Piston 40 also includes a plurality of nozzles 48 generally longitudinally defined through the lower end or face of piston 40. Nozzles 48 provide a predetermined pressure drop or differential across the piston as a function of hydraulic pressure or flow rate of mud through the drill string. The lower portion of piston 40 extends and forms a bottom ratchet spring assembly 50 of conventional design. Bottom ratchet spring assembly 50 permits relative downward movement of piston 40 with respect to stripper tube 34 but not the reverse. In other words, when stripper tube 34 is stationary, ratchet spring assembly 50 permits downward movement of piston 40 or equivalently, when piston 40 is stationary, ratchet spring assembly 50 permits upward movement of stripper tube 34 while all other movement is prevented by bottom ratchet spring assembly 50.

Stripper tube 34 is axially disposed into fixed upper ratchet spring assembly 52. Upper ratchet spring assembly 52, which is of conventional design, includes within an upper fixture 54 which also integrally forms stripper tube latch fingers 56. Upper fixture 54 also includes a plurality of bypass ports 58 for permitting the flow of hydraulic fluid from the interior of drill collar 14 through upper fixture 54 into the upper space defined by piston 40 and thence through nozzles 48. Stripper tube latch fingers 56 are of conventional design and are described in greater detail in connection with the above referenced applications.

Figure 1B:
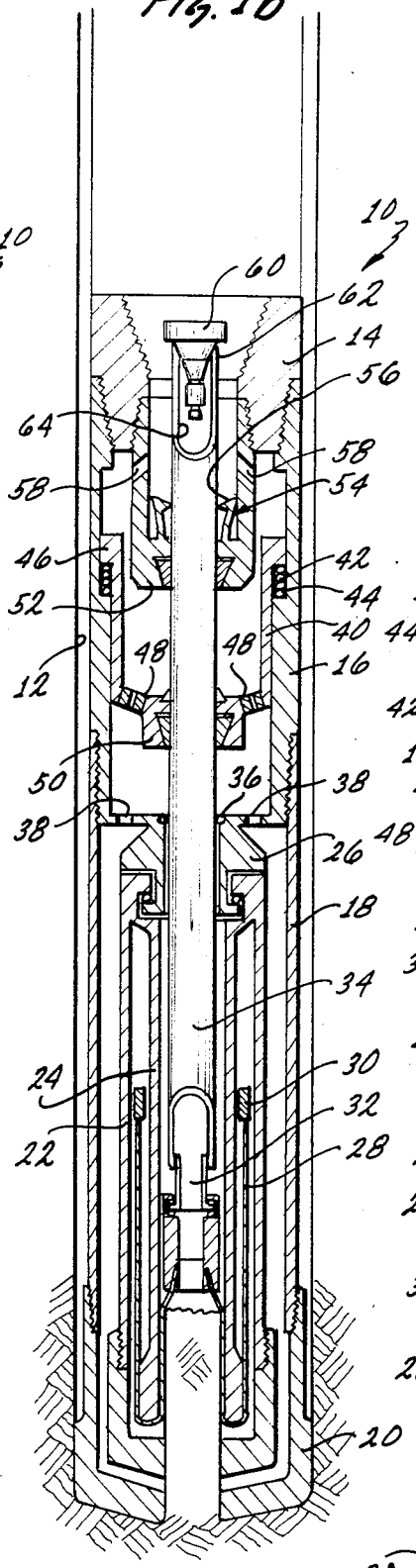
FIG. 1*b* is the sectional view of FIG. 1*a* after a predetermined amount of core has been cut and the tensioning mechanism activated.
Figure 1C:
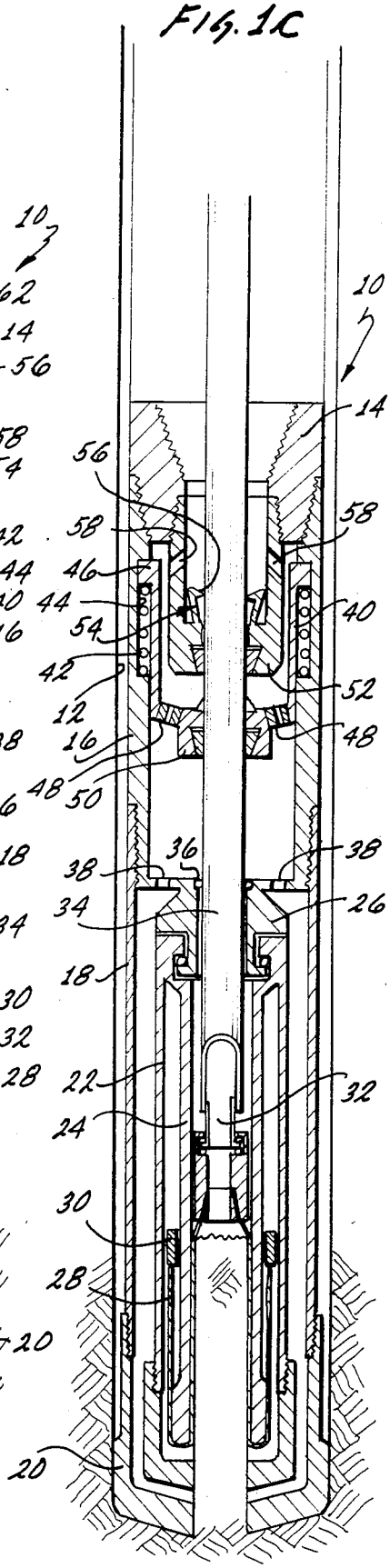
FIG. 1*c* is the sectional view of FIGS. 1*a* and 1*b* shown after an additional amount of core has been cut.

Each of the basic elements of the first embodiment of the invention now being described, their relationship and structure can better be understood in connection with its operation as illustrated in the sequence of Figures depicted by FIGS. 1*a*, 1*b* and 1*c*. Coring is begun by dropping a stripper tube release plug 60 into the drill string according to conventional practice. Ultimately, stripper tube release plug will seat into the upper end 62 of stripper tube 34 and due to its configuration as assisted by hydraulic pressure spread latch fingers 56 as best shown in FIG. 1*b* to permit upward axial displacement of stripper tube 34. In this connection, stripper tube 34 is provided with an axial bore 64 through which hydraulic fluid is pumped to the inner gage of bit 20 until coring operation begins, namely until axial bore 64 is sealed by release plug 60. Thereafter, fluid is forced through ports 58 of upper fixture 54.

Turn now again to FIG. 1*b* which shows the sectional view of FIG. 1*a* after a first increment of core has been cut. An increase of hydraulic fluid velocity or pressure from the drill platform is transmitted down the drill string to produce a sufficient differential pressure drop across piston 40, as determined by nozzles 48, to overcome the preloaded force of spring 42 thereby driving piston 40 downwardly to the fully compressed position as shown in FIG. 1*b*. As piston 40 is driven down stripper tube 34, bottom ratchet spring 50 ratchets downwardly thereby fixing the relative position of piston 40 in stripper tube 34. Thereafter, the hydraulic pressure is decreased allowing the force of spring 42 to urge piston 40 to the fully up position as shown in FIG. 1*a*. However, stripper tube 34 is now fixed by ratchet spring 50 to piston 40 and in turn is connected at its lower end to wire mesh sleeve 28. However, prior to the first activation of piston 40, as shown in FIG. 1*b*, a sufficient amount of core has been cut and disposed within sleeve 28 to allow sleeve 28 to constrict and seize the core. Stripper tube 34 then remains under tension as bit 20 continues to cut and move downwardly within bore hole 12.

After stripper tube latch fingers 56 are released by plug 60, a predetermined amount of core is cut as shown in FIG. 1*b* thereby drawing a portion of sleeve 28 about the cut core as bit 20 and outer barrel 18 begin to descend or cut into the rock formation. Lower ratchet assembly 50 and upper ratchet assembly 52 each permit downward movement of piston 40 and upper fixture 54 respectively with respect to stripper tube 34.

After a length of core equal to the maximum throw or displacement of piston 40 as shown in FIG. 1*b* has been cut, tool 10 will assume the configuration as illustrated in sectional view in FIG. 1*c*. Turn now to FIG. 1*c* wherein piston 40 is again shown in a fully up-position as was the case in FIG. 1*a*. However, an additional length of core has been cut and disposed into inner tube 24 as bit 20, outer barrel 18 and inner tube 24 continue to be downwardly displaced into the rock formation. As illustrated by a comparison of FIGS. 1*a*–1*c*, stripper tube 34 remains longitudinally fixed with respect to the rock formation once the coring operation has begun.

After the additional increment of core is cut as shown in FIG. 1*c*, the pressure is again increased within the drill string to thereby advance piston 40 to the fully compressed position as shown in FIG. 1*b*. Tool 10 is then cycled between the configuration of FIGS. 1*b* and 1*c* until the desired amount of core has been cut. However, at no time need the rotary table or hydraulic pumping operation be stopped in order to initiate or permit the coring operation to continue.

Figure 4:
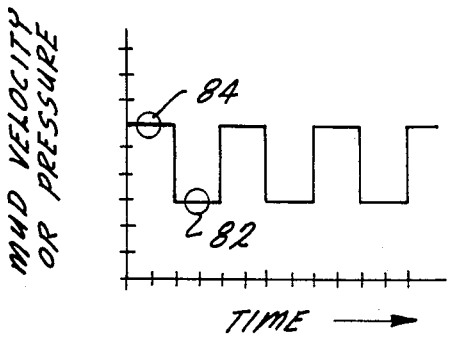
FIG. 4 is a diagrammatic graph of hydraulic pressure versus time illustrating the operation of the invention.
Figure 5:
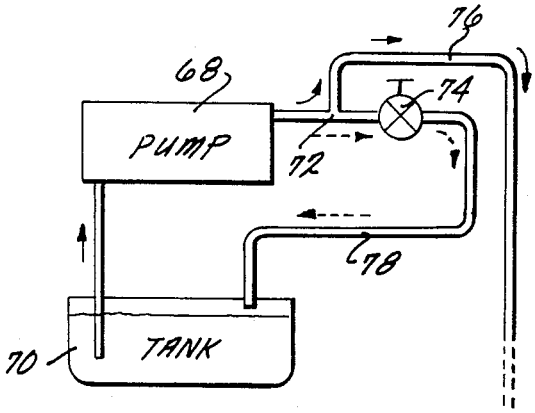
FIG. 5 is a symbolic depiction of the hydraulic circuit used to activate operation of the invention.

Before considering the second and third embodiments of the invention as shown in connection with FIGS. 2 and 3, turn first to the diagrammatic depictions of FIGS. 4 and 5. FIG. 4 illustrates the time graph of mud velocity or pressure which can be used to activate piston 40 as described in connection with FIGS. 1*a*–1*c*. FIG. 5 diagrammatically depicts a hydraulic circuit for implementing the operation shown in FIG. 4. Turn now to FIG. 5. A conventional mud pump 68 drawing from a mud reservoir or tank 70 pumps drilling mud and hydraulic fluid to a T-intersection 72. Just downstream from the T-intersection 72 is a selectively operable valve 74. A portion of the hydraulic fluid is directed through line 76 in front of valve 74 to the drill string. Valve 74 in turn has its output coupled to a bypass pipe 78 returning a portion of the hydraulic fluid to tank 70. Thus, when valve 74 is opened the velocity of mud and pressure set up in line 76 is depicted by the lower pressure or velocity line shown in region 82 of FIG. 4. When valve 74 is closed, the full pressure and velocity of the output pump 78 is directed through T-intersection 72 to the drill string line 76 as depicted in regions 84 of the graph in FIG. 4. Thus valve 74 can be manually or automatically opened and closed according to conventional means as determined by the platform measurement of drill depth to increase and decrease hydraulic mud velocity or pressure within the drill string. Each time the pressure is increased as depicted by regions 84 of FIG. 4, piston 40 will be compressed to the fully downward position as depicted in FIG. 1*b*. Each time the pressure is returned to the level indicated by regions 82 of FIG. 4 by opening valve 74, piston 40 will be permitted as drilling proceeds to tension stripper tube 34 and return to the fully up position as depicted in FIG. 1*c*. It must be understood that many means may be provided for opening and closing valve 74 which are included within the scope of the present invention. Any means now known or later discovered for effecting the mud velocity or pressure variations as depicted in FIG. 4 could be used to advantage in combination with tool 10 as depicted in the various embodiments of FIGS. 1*a*–1*c*, 2 and 3.

Turn now to the second embodiment of the invention as depicted in sectional view in FIG. 2. FIG. 2 illustrates a portion of tool 10 wherein like elements are referenced with like numbers. In the embodiment of FIG. 2, drill collar 14 is connected to a stripper sub 88 which in turn is connected at its opposing end to a conventional core barrel 90 similar to that illustrated in connection with FIGS. 1*a*–1*c*. In the embodiments of FIGS. 2 and 3, core barrel 90 includes a bearing assembly (not shown) similar to bearing assembly 26 of FIGS. 1*a*–1*c* and intermediate tube, flexible wire or rubber sleeve, and inner tube (each not shown) co-acting with a stripper tube 92 in substantially the same way as those corresponding elements coact in the combination described and depicted in FIGS. 1*a*–1*c*.

In the embodiment of FIG. 2, stripper tube 92 is axially disposed through a lower fixed ratchet assembly 94 and an upper piston ratchet assembly 96. Lower ratchet assembly 94 is of generally conventional design and is longitudinally fixed with respect to stripper sub 88. For example, lower ratchet assembly 94 includes a lower ratchet spring 98 disposed within fixed ratchet housing 100, concentrically disposed about stripper tube 92 and bearing against a lower ratchet member 102. Lower ratchet member 102 engages mating grooves 104 defined in stripper tube 92 in a conventional manner. Thus, lower ratchet assembly 94 allows stripper sub 88 and core barrel 90 to be longitudinally displaced downwardly with respect to stripper tube 92 but not the reverse. Alternatively, stripper tube 92 can move upwardly within lower ratchet assembly 94 with respect to stripper sub 88.

Upper piston assembly 96 is similarly structured and includes a ratchet housing 106, upper ratchet spring 108 and upper ratchet member 110, which are disposed with respect to each other and with respect to stripper tube 92 in a manner identical to that of lower ratchet assembly 94. In other words, upper and lower ratchet assemblies 96 and 94, respectively, each provide the same type of ratcheting engagement between stripper tube 92 and sub 88.

However, upper piston ratchet assembly 96 is formed with or connected to a slidable piston 112. Piston 112 is hydraulically sealed to stripper tube 92 by means of O-rings 114 and tube sub 88 by means of O-rings 116. Piston 112 also includes a plurality of nozzles 118 similar to nozzles 48 described in connection with FIGS. 1*a*–*c*. A return spring 120 is preloaded and resiliently urges piston 112 in the fully upward position as depicted in FIG. 2. Return spring 120 may be a coil spring such as suggested by the illustration of FIGS. 1*a*–*c* or may be a series of Bellville washers or other equivalent means.

The operation of the embodiment of FIG. 2 may now be described. The fluidic velocity or pressure is increased within the drill string and is communicated to space 121 above piston 112. Stripper tube 92 at this point has been activated by selective closure through the use of a conventional stripper tube release plug similar to the manner shown and described in FIGS. 1*a*–1*c*. The increase in fluidic velocity is thereby exerted thru nozzles 118 in piston 112 thereby creating a pressure differential sufficient to overcome the preloaded force of return spring 120. The piston will then compress downwardly thereby driving upper ratchet 106 down stripper tube 92. After full compression of piston 112, the hydraulic pressure is reduced in the manner described in connection with FIGS. 4 and 5 and an upward tension is exerted upon stripper tube 92 by return spring 120 acting through piston 112 and upper ratchet 106. Rotary drilling continues until an increment of core is cut equal to the maximum throw of piston 112 at which point the cycle is again repeated. However, when piston 112 drives upper ratchet 106 downwardly, fixed lower ratchet assembly 94 prevents stripper tube 92 from being forced downwardly and also maintains the tension on stripper tube 92 which has been exerted upon stripper tube 92 in a prior piston stroke. In other words, stripper tube 92 is placed under tension which is transmitted to the mesh sleeve below the portion of tool 10 depicted in FIG. 2. The mesh sleeve constricts, grabs the core as it is being disposed into the inner barrel and retains its grip as long as stripper tube 92 is under tension. Tension is maintained on stripper tube 92 even during the forward piston strokes when the tensile force from return spring 120 is absent by the clamping action of lower fixed ratchet assembly 94. A certain amount of resiliency is stored within the wire mesh sleeve and is maintained by lower ratchet assembly 94. However, as stripper sub 88 and core barrel 90 descend into the bore hole as additional core is cut, lower ratchet assembly 94 permits the relative downward movement of stripper sub 88 with respect to stationary stripper tube 92, during which time upper ratchet assembly 106 maintains stripper tube 102 under tension. Therefore, at all times stripper tube 92 is being seized either by lower ratchet assembly 94 or upper ratchet assembly 106 to maintain the sleeve and core under tension.

Turn now to FIG. 3 wherein a third embodiment of the invention is illustrated in sectional view. Again, only a portion of tube 10 is illustrated and like elements are referenced with like numerals. Drill collar 14 in the third embodiment is connected to stripper sub 122 which is connected at its opposing end to conventional core barrel 90 identical to core barrel 90 of the second embodiment of FIG. 2. Stripper sub 122 includes a fixed lower ratchet assembly 94 identical to that shown in the second embodiment. Similarly, a piston upper ratchet assembly 106 is axially disposed above lower ratchet assembly 94 and is identical to the same numbered ratchet assembly described in connection with FIG. 2.

However, slidable piston 124 of the third embodiment is distinguished from piston 112 by the lack of any nozzles 118 or equivalent restrictions. Instead, piston 124 includes a plurality of ports 126 defined therethrough which freely permit longitudinal flow of hydraulic fluid through the piston. Therefore, the embodiment of FIG. 3 shows the employment of the invention in the case where the volume or pressure of hydraulic fluid which must be delivered to the drill bit below is not be substantially diminished or restricted.

As before, a return spring 128 is concentrically disposed about piston 124 and is preloaded to provide a means for resiliently urging piston 124 to the upward position illustrated in FIG. 3 and for exerting a tensile force on stripper tube 92 through piston ratchet assembly 106. However, piston 124 is sealed to stripper sub 122 not only by means of an O-ring 130 similar to O-ring 116 of the embodiment of FIG. 2, but also by means of a lower O-ring 132. Therefore, the space 134 defined between piston 124 and stripper sub 122 is completely sealed at all times from the interior of the drill string. A plurality of ports 136 are defined through stripper sub 132 which communicates interior space 134 with the exterior environment outside of the drill string and inside bore hole 12.

The operation of the embodient of FIG. 3 may now be understood. When a velocity or pressure increase is transmitted down the drill string as described in connection with FIGS. 4 and 5, there is very little pressure drop between region 120 above piston 124 and region 136 below piston 124. The pressure differential, which causes the downward movement of piston 124 and thence the ratcheting operation, is instead created between region 120 and space 134 which is vented by means of ports 136 to the low pressure exterior environment outside the drill string.

Both the second and third embodiments of FIGS. 2 and 3 respectively have been shown in the absence of any stripper latch fingers such as shown as latch fingers 56 in FIGS. 1*a–c*. It is contemplated that such latching fingers may be omitted in the embodiments of FIGS. 2 and 3 if desired, since the drill string is rigid, unlike the prior art assembly which included a slip joint allowing for telescopic movement of the drill string to activate a ratcheting operation. In other words, during normal operation there is no means for prematurely displacing stripper tube 92 with respect to the stripper sub or core barrel. However, it is entirely within the scope of the invention that stripper latch fingers 56 could be included in each of the embodiments as a redundant operational feature.

Many modifications and alterations may be made by those having ordinary skill in the art without departing from the spirit and scope of the invention. For example, although each of the embodiments have shown an upper and lower ratchet assembly disposed within a stripper sub, it is entirely possible, if desired, that such ratchet assemblies could be separated and individually placed elsewhere within the drill string. Similarly, although the invention has been shown in connection with FIGS. 1*a–c* in connection with a particular type of intermediate, flexible sleeve, and inner tube, each of these elements or their combination could be modified or altered by means now known or later discovered without departing from the spirit of the invention.

Therefore, it must be understood that the illustrated embodiments are shown only for the purposes of example and clarity and are therefore not to be read as limiting the invention which is defined by the following claims.

We claim:

1. An apparatus for use in a coring tool in a drill string in which hydraulic pressure is selectively applied, said drill string including a core barrel, and a flexible sleeve for receiving a core into said core barrel, said sleeve radially contracting upon application of longitudinal tension thereto, said apparatus comprising:

a stripper tube coupled to said flexible sleeve and concentrically disposed within said core barrel;

piston means slidingly disposed within said coring tool between a first upper and second lower longitudinal position, said stripper tube being disposed through said piston means and generally longitudinally displaceable with respect thereto, said piston means selectively seizing said stripper tube when said piston means is urged longitudinally upward; and resilient means for selectively applying and continuously maintaining an upward tensile force to said stripper tube independent of hydraulic pressure in said coring tool and thence applying said tensile force to said flexible sleeve and core disposed therein, whereby a core may be cut from a highly fractured rock formation and retentively disposed within said flexible sleeve while said sleeve is continuously maintained under tension by combined operation of said stripper tube and piston means.

2. The apparatus of claim 1 wherein said resilient means comprises resilient spring means coupled to said piston for urging said piston upwardly from said second position to said first position; and a fixed ratchet means disposed within said coring tool and fixed thereto, said stripper tube being disposed through said fixed ratchet means and longitudinally displaceable with respect thereto, said fixed ratchet means for maintaining said tensile force on said stripper tube, flexible sleeve and core while said piston means is being selectively actuated.

3. An apparatus for use in a coring tool in a drill string including a core barrel, and a flexible sleeve for receiving a core into said core barrel comprising:

a stripper tube coupled to said flexible sleeve and concentrically disposed within said core barrel; and piston means slidingly disposed within said coring tool, said stripper tube being disposed through said piston means and generally longitudinally displaceable with respect thereto, said piston means for selectively applying a tensile force to said stripper tube and thence to said flexible sleeve and core disposed therein, whereby a core may be cut from a highly fractured rock formation and retentively disposed within said flexible sleeve while said sleeve is continuously maintained under tension by combined operation of said stripper tube and piston means, wherein said piston means is actuated by an increase in hydraulic pressure transmitted through said coring tool, wherein said piston means includes at least one nozzle for creating a pressure differential therethrough across said piston in response to said increased hydraulic pressure in said coring tool to create an actuating force on said piston means.

4. An apparatus for use in a coring tool in a drill string including a core barrel, and a flexible sleeve for receiving a core into said core barrel comprising:

a stripper tube coupled to said flexible sleeve and concentrically disposed within said core barrel; and piston means slidingly disposed within said coring tool, said stripper tube being disposed through said piston means and generally longitudinally displaceable with respect thereto, said piston means for selectively applying a tensile force to said stripper tube and thence to said flexible sleeve and core disposed therein, whereby a core may be cut from a highly fractured rock formation and retentively disposed within said flexible sleeve while said sleeve is continuously maintained under tension by combined operation of said stripper tube and piston means, wherein said piston means is resiliently biased by a return spring means for configuring said piston means in a first noncompressed configuration with a predetermined magnitude of force.

5. The apparatus of claim 4 wherein said piston means further comprises at least one nozzle disposed therein to permit restricted longitudinal flow of hydraulic fluid through said piston means and to create a pressure differential across said piston means in response to an increased pressure communicated through said drill string to said piston means, said pressure differential longitudinally displacing said piston means to compress said return spring means thereby selectively engaging said piston means at a displaced longitudinal displacement with respect to said stripper tube.

6. The apparatus of claim 4 wherein said piston means further comprises at least one port longitudinally disposed therethrough to provide for substantially free longitudinal flow of hydraulic fluid through said piston means, said piston means being slidingly disposed in said coring tool and defining between the exterior circumferential surface of said piston means and the interior adjacent surface of said coring tool a hydraulically sealed chamber, said chamber being circumferentially defined about said piston means and within said coring tool, and further comprising at least one port communicating said chamber with the environment outside said coring tool, a pressure differential being established between the interior of said piston means and said chamber in communication with said environment to thereby longitudinally displace said piston means within said coring tool and compress said return spring means.

7. An apparatus for recovering a core cut by a coring bit and disposed in a coring tool within a flexible sleeve maintained under tension in a drill string comprising:

a stripper sub connected to said drill string;

a stripper tube axially disposed through said stripper sub and coupled at one end to said flexible sleeve;

a slidable piston disposed in said stripper sub and longitudinally displaceable therein, said stripper tube being axially disposed through said piston, said piston being longitudinally displaced within said stripper sub in response to an increase in hydraulic pressure communicated through said drill string to said stripper sub;

a piston ratchet assembly connected to said piston and longitudinally displaceable therewith, said stripper tube disposed through said piston ratchet assembly, said piston ratchet assembly for preventing longitudinal downward movement of said stripper tube relative to said piston ratchet assembly and piston; and return spring means coupled to said piston for urging said piston in a longitudinally upward direction, whereby said piston is longitudinally displaced downwardly in response to said increase in hydraulic pressure thereby carrying said piston ratchet assembly downwardly along said stripper tube, said piston ratchet assembly engaging said stripper tube and preventing relative upward movement of said piston with respect to said stripper tube, said return spring means being compressed and exerting an upward tension on said stripper tube communicated therethrough to said flexible sleeve and core disposed in said sleeve.

8. The apparatus of claim 7 wherein said piston includes at least one nozzle to permit hydraulic fluid to longitudinally pass through said piston subject to a pressure differential caused by said nozzle, said pressure differential created across said piston urging said piston into said downward longitudinal displacement.

9. The apparatus of claim 7 wherein said piston includes at least one port defined therethrough to allow substantially free longitudinal flow of hydraulic fluid through said piston, said piston and stripper sub defining a circumferential chamber therebetween, said chamber being sealed from the interior of said stripper sub and communicated with the exterior environment of said stripper sub, whereby an increase of pressure within said stripper sub creates a pressure differential between said interior of said stripper sub and said chamber defined between said piston and stripper sub, said pressure differential urging said piston into said downward longitudinal displacement.

10. The apparatus of claim 7 further comprising a fixed ratchet assembly connected to said stripper sub, said stripper tube being axially and longitudinally disposed through said fixed ratchet assembly, said fixed ratchet assembly for prohibiting downward longitudinal movement of said stripper tube with respect to said fixed ratchet assembly, whereby tension is maintained on said stripper tube and said flexible sleeve even when said piston ratchet assembly is being downwardly and longitudinally advanced along said stripper tube.

11. The apparatus of claim 10 wherein said fixed ratchet assembly is disposed within said stripper sub longitudinally below said piston and piston ratchet assembly.

12. The apparatus of claim 10 wherein said fixed ratchet assembly is disposed within said stripper sub longitudinally above said piston and piston ratchet assembly.

13. A method for retrieving a core from a bore hole cut by a coring bit comprising the steps of:

disposing said core cut by said coring bit into a sleeve, said sleeve arranged and configured to restrict in diameter and seize said core when under tension:

tensioning said sleeve by applying an upward tensile force thereto through a stripper tube coupled to said sleeve, said tensile force being applied to said stripper tube by a longitudinally slidable piston disposed within said coring tool, said piston displaceable through a maximum longitudinal piston displacement, said piston being resiliently longitudinally urged upward to create said tensile force coupled by said piston to said stripper tube and thence to said sleeve and core;

continuously cutting an additional increment of length of said core substantially equal to the maximum longitudinal displacement of said piston within said coring tool;

simultaneously longitudinally displacing said piston upwardly within and relative to said coring tool through said maximum piston displacement by a resilient force applied to said piston as said increment of core is cut;

simultaneously and continuously maintaining said tension on said sleeve while longitudinally displacing said piston downward through said distance of maximum piston displacement independent of hydraulic pressure in said coring tool; and repeating said steps of disposing said core into said sleeve, tensioning said sleeve, continuously cutting said core, simultaneously displacing said piston, and simultaneously and continuously maintaining said tension on said sleeve and core while longitudinally displacing said piston in order to cyclically and continuously cut additional increments of said core under continuous tension on said sleeve until a predetermined length of core has been cut.

14. A method for retrieving a core from a bore hole cut by a coring bit comprising the steps of:

disposing said core cut by said coring bit into a sleeve, said sleeve arranged and configured to restrict in diameter and seize said core when under tension;

tensioning said sleeve by applying an upward tensile force thereto through a stripper tube coupled to said sleeve, said tensile force being applied to said stripper tube by a longitudinally slidable piston disposed within said coring tool, said piston displaceable through a maximum longitudinal piston displacement, said piston being resiliently longitudinally urged upward to create said tensile force coupled by said piston to said stripper tube and thence to said sleeve and core;

continuously cutting an additional increment of length of said core substantially equal to the maximum longitudinal displacement of said piston within said coring tool;

simultaneously longitudinally displacing said piston upwardly within said coring tool through said maximum piston displacement as said increment of core is cut;

simultaneously and continuously maintaining said tension on said sleeve while longitudinally displacing said piston downward through said distance of maximum piston displacement; and repeating said steps of disposing said core into said sleeve, tensioning said sleeve, continuously cutting said core, simultaneously displacing said piston, and simultaneously and continuously maintaining said tension on said sleeve and core while longitudinally displacing said piston in order to cyclically and continuously cut additional increments of said core under continuous tension on said sleeve until a predetermined length of core has been cut, when said step of longitudinally displacing said piston comprises the steps of:

increasing hydraulic pressure within said coring tool above a predetermined magnitude in order to create a pressure differential across said piston;

compressing a return spring when said piston is longitudinally displaced in response to said pressure differential; and coupling said piston to said stripper tube through a piston ratchet assembly, said piston ratchet assembly only permittng relative downward movement of said piston ratchet assembly and piston with respect to said stripper tube.

15. The method of claim 14 where said step of increasing pressure within said coring tool to produce a pressure differential across said piston comprises the step of creating said pressure differential across said piston through a plurality of nozzles disposed in said piston, said nozzles restricting longitudinal flow of hydraulic fluid through said coring tool and piston.

16. The method of claim 14 where said step of increasing pressure within said coring tool to create said pressure differential comprises the step of creating a pressure differential between the interior of said piston and a chamber circumferentially defined between said piston and the interior surface of said coring tool, said chamber being communicated with the environment exterior to said coring tool whereby hydraulic pressure within said chamber is maintained at ambient pressure levels exterior to said coring tool.

* * * * *